US006578706B2

(12) United States Patent
Thompson

(10) Patent No.: US 6,578,706 B2
(45) Date of Patent: Jun. 17, 2003

(54) FOLDING PORTFOLIO ORGANIZER

(76) Inventor: Kimberly Ann Thompson, 17274 E. View Dr., Chino Hills, CA (US) 91709

( * ) Notice: Subject to any disclaimer, the term of this patent is extended or adjusted under 35 U.S.C. 154(b) by 0 days.

(21) Appl. No.: 09/972,635

(22) Filed: Oct. 9, 2001

(65) Prior Publication Data

US 2002/0125150 A1 Sep. 12, 2002

Related U.S. Application Data

(60) Provisional application No. 60/244,585, filed on Oct. 31, 2000.

(51) Int. Cl.[7] ..... A45C 11/18

(52) U.S. Cl. ..... 206/214; 206/215; 206/232; 206/425

(58) Field of Search ..... 206/215, 214, 206/371, 224, 232, 425; 150/112, 129

(56) References Cited

U.S. PATENT DOCUMENTS 4,716,948 A * 1/1988 Brissette ..... 150/132
5,002,401 A * 3/1991 Blackman ..... 383/38
5,020,673 A * 6/1991 Adams ..... 206/581
5,388,689 A * 2/1995 Kroop et al. ..... 206/214
5,794,676 A * 8/1998 Shattuck ..... 150/131
5,984,092 A * 11/1999 Heard-Willmon ..... 206/233

* cited by examiner

*Primary Examiner*—Jacob K. Ackun
(74) *Attorney, Agent, or Firm*—Roger A. Marrs

(57) ABSTRACT

A foldable portfolio organizer having a plurality of board stiffeners arranged in rows and columns and covered by an inner and an outer sheet of flexible fabric material so that folds or plications separate the rows and columns permitting folding the board stiffeners into a storage and carrying position and unfolding into an operative position. Pads of data recording forms are disposed on said inner sheet associated with each board stiffener and clip devices are employed to releasably retain each pad in place. An accordion fold brief case is included on a central column and a hard surface board is included in the central column separated by a longitudinal fold plication. The pads and associated board stiffeners are disposed laterally of the central column. A hanger strap is included for hangably supporting the organizer and separate pouches and sleeves are provided for holding writing implements and ancillary items, such as pins, labels, stickers, etc.

19 Claims, 2 Drawing Sheets

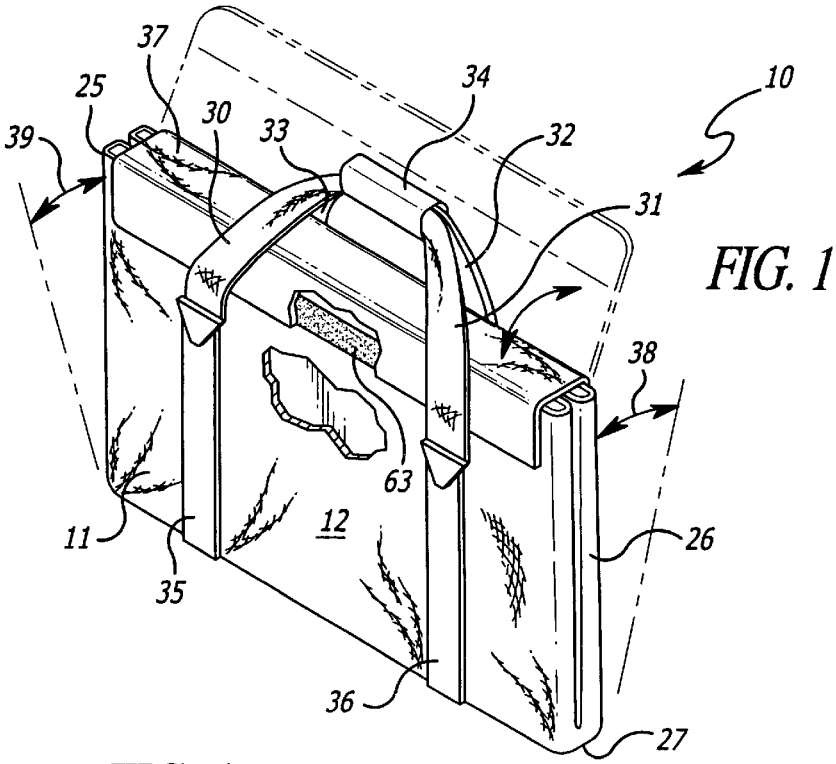
FIG. 1
FIG. 4
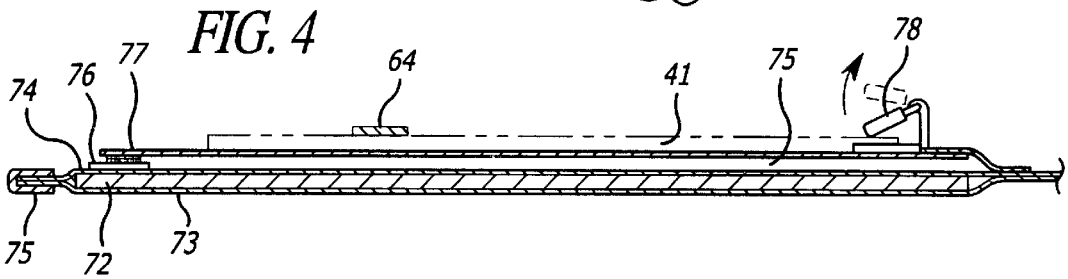
FIG. 2
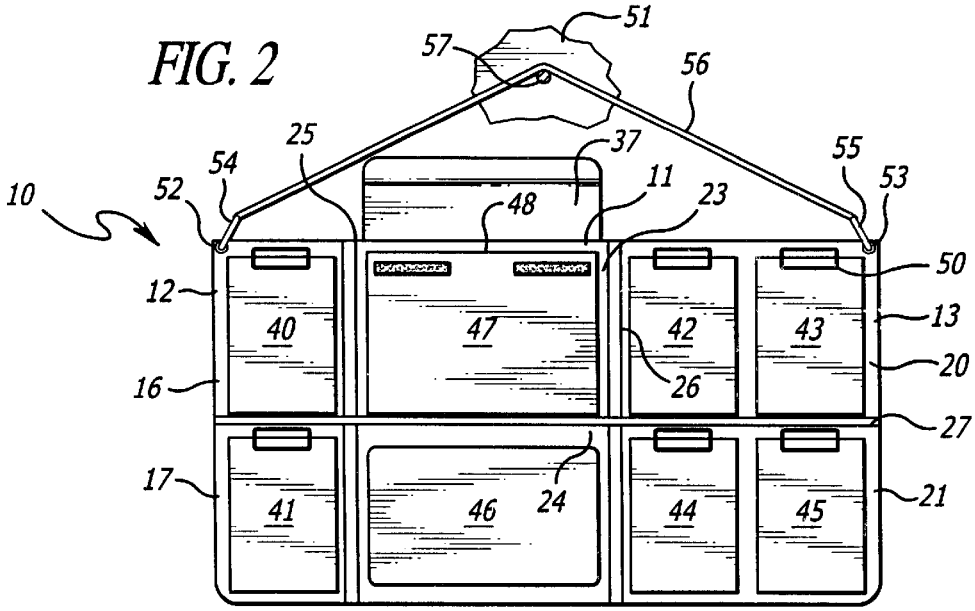

FOLDING PORTFOLIO ORGANIZER

Priority based on Ser. No. 60/244,585 filed Oct. 31, 2000.

BACKGROUND OF THE INVENTION

1. Field of the Invention

The present invention relates to the field of an organizer for holding a plurality of selected items such as forms, writing implements, selected papers, etc., and more particularly to a novel organizer having an open or operative position exposing a plurality of specialized forms and working surfaces as well as providing an accordion style briefcase and which further has a storage position when folded over upon itself permitting the organizer to be readily carried from one place to another and which may be particularly useful in emergency situations where data recording is essential.

2. Brief Description of the Prior Art

In the past, it has been the conventional practice to provide an organizer such as a carrying case, pocketbook, or other type of organizer apparatus which holds a plurality of papers or selected items relevant to the recording and storage of data. Such examples of prior item organizers are disclosed in U.S. Pat. Nos. 5,002,401; 5,020,673; and 5,984,092.

Difficulties and problems have been encountered with such conventional item organizers which stem largely from the fact that while these devices or apparatus include either multiple pockets and/or foldable multi-dash panel construction, the organizers are either too complicated for convenient use especially for display and equally inconvenient is the ability to lay the organizer in a flat orientation such as on the hood of a vehicle so that the user may readily enter proper information on necessary documents. Also, many of the previous foldable portfolios or organizers are unable to hold thicker and substantially non-planer items which are normally held in a carrying bag or briefcase. More recent portfolios, organizers or cases typically are comparatively complex and expensive and are cumbersome for an organized, appealing display during use. For example, at the scene of an emergency such as an accident or catastrophe, individuals of all types of occupations and employments need to enter pertinent information onto document forms for subsequent processing at base stations or operations. Such occupations include primarily law enforcement, fire department, military organizations, search and rescue units as well as commercial sales people. In emergencies, it is especially important that the proper forms or documents be filled out and usually personnel will work from the top of their vehicle hood or certainly in outdoor environments.

Therefore, a long-standing need has existed to provide an item organizer which can hold documents or papers needed to be filled out in an emergency so that the papers or documents will not blow away and which will provide a working area for such personnel in the field. The organizer should be readily foldable for storage and for transport from place to place without disrupting official's procedures or operations. The organizer can also be completely folded for storage in transport as well as unfolded so that a variety of documents or forms are displayable and which further includes a hardboard for supporting papers needed to be written upon and preferably a briefcase for holding books, pamphlets, procedures or the like.

SUMMARY OF THE INVENTION

Accordingly, the above problems and difficulties are avoided by the present invention which provides an item organizer of unitary construction which includes a plurality of panels arranged in side-by-side relationship and wherein the panels include a central panel joining a pair of lateral or intermediate panels. Each panel is divided into an upper section and a lower section, separated by a major or longitudinal fold or plication extending along the length of the organizer. The lateral panels are joined on opposite sides of the central panel by folds or plications extending normal or perpendicular to the longitudinal major fold or plication.

Selected sections are provided with pockets, clips, hardboard working surfaces, an accordion folder and other implement holding portions. A variety of form pads pertaining to documents requiring official information and pertaining to the collection of specific information are provided on the selected sections in addition to some sections which are provided with pockets. The organizer may be folded along the plications from an open, opposite position into a closed storage position suitable for carrying. Grommets are provided on corners for attachment with a hanger for supporting the organizer on a wall when in its operative position.

Therefore, it is among the primary objects of the present invention to provide an item organizer adapted to assist any and all types of occupations or individuals and especially those persons in the profession of law enforcement, fire department, military organizations as well as search and rescue units.

Another object of the invention is to provide a novel item organizer which may be unfolded from a stored position at the site of an emergency and may be placed on the top or hood of a vehicle so that the user may have a variety of official documents and forms exposed preparatory for entry of pertinent information.

Yet another object of the present invention is to provide a novel item organizer which may be unfolded from a storage position into an operative position exposing an interior composed of panels and sections on which a variety of pads of document forms are placed and which further includes an accordion-type briefcase as well as a hardboard working surface.

Still another object of the invention resides in providing a novel item organizer having at least three to six panels which are readily foldable with respect to one another in order to fold into a storage condition for readily transport from one place to another or for readily unfolding into an operative position which will expose and display a variety of documents, forms, writing implements and storage compartments whereby the user may have ready access thereto.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view illustrating the novel foldable portfolio organizer incorporating the present invention and illustrated in its folded or storage position;

FIG. 2 is a reduced plan view of the interior of the folding portfolio organizer shown in FIG. 1 when it is unfolded into its operative position;

FIG. 4 is an enlarged, fragmentary cross-sectional view of a portion of the item organizer shown in FIG. 3 as taken in the direction of arrows 4—4 thereof.

DESCRIPTION OF PREFERRED EMBODIMENT

Figure 5:
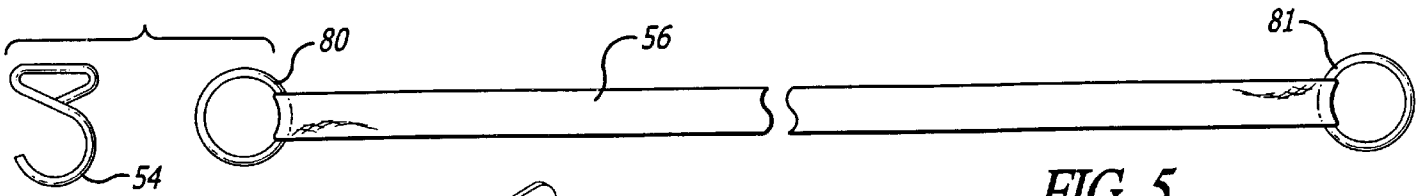
FIG. 5 is a top plan view of a hook and hanger arrangement useful in supporting the folding portfolio organizer on a wall.

Referring to FIGS. 1 and 2, the novel folding portfolio organizer incorporating the present invention is illustrated in the general direction of arrow 10 and is shown in FIG. 1 in its folded or storage position. In FIG. 2, the organizer is illustrated in its unfolded or open position exposing the interior of the organizer.

In FIGS. 1 and 2, it can be seen that the organizer includes a main or central panel 11 having a first lateral or intermediate panel 12 and a second lateral or intermediate panel 13. Each of the respective panels includes sections. For example, panel 12 is divided into an upper and lower section indicated by numerals 16 and 17 respectively while panel 13 is divided into upper and lower sections 20 and 21 respectively. The main or central panel 11 includes an upper central section 23 and a lower section 24.

The lateral panels 12 and 13 are disposed on opposite sides of the central panel 11 and are joined to the sides by means of folds or plications 25 and 26. However, the upper sections of panels 11, 12, and 13, are hingably joined with lower sections 17, 24 and 21 by means of a longitudinal fold or plication 27.

Referring to FIG. 1 in detail, the organizer is illustrated in its folded condition so that it may readily be transported from one place to another. In this position, a carrying strap arrangement is illustrated in which straps 30, 31, 32, and 33 are drawn together and detachably connected together by means of a hand grip 34. It can be seen that the strap arrangement is attached to the outside of the organizer and includes reinforcing straps 35 and 36 which are fixly attached to the outside of central panel 11. Also, it can be seen that a closure flap indicated by numeral 37 is provided and is illustrated in broken lines in its open position so that the organizer may be unfolded along the longitudinal or central fold or plication 27 in the direction of the arrows 38 and 39 respectively. When the organizer is unfolded or deployed into its operative position from that shown in FIG. 1, the interior is exposed as illustrated in FIG. 2.

Referring now in detail to FIG. 2, the central panel has been fully deployed and the lateral or intermediate panels 12 and 13 have been fully deployed so as to totally expose the interior. The interior surface of the organizer includes a plurality of pads, such as indicated by numeral 40 and 41, which are carried on the upper and lower sections 12 and 17 on the first intermediate panel 16. It can also be seen that the intermediate panel 13 includes at least four (4) pads indicated by numerals 42, 43, 44, and 45 respectively. Each of the pads contains a plurality of information sheets intended to be filled out by the user in the procedure of collecting information during an emergency situation. Pad 40 may contain sheets pertaining to a particular phase of the situation while pad 41, 42, 43 may relate to collection of other information pertaining to formalities. Pads 44 and 45 may contain sheets still relating to further collection of data which may or may not include diagrams, statements or the like. A special feature of the present invention resides in providing the lower section 24 of panel 11 with a hard surface board 46 that is detachably connected to the section 24. This represents a hard surface on which various pages or sheets from the pad may be placed in order to provide a hard surface for writing or inscribing information. Also, the upper section 23 of panel 11 includes an accordion-type case 47 having an opening 48 so that materials may be introduced into the case or withdrawn therefrom. Also, it is to be noted that the various sections include clips, such as clip 50 associated with pad 43, which permits the pads to be interchanged or to be readily removed at the selection of the user.

It is to be understood that FIG. 2 illustrates a general layout for the organizer when the organizer is deployed into its operative or open position. The organizer can then be laid on the top or hood of an automobile and the user can readily fill out the form for collection of pertinent information. Also, if it is desirable to hang the organizer from a wall, such as indicated by numeral 51, the corners of the organizer are provided with grommets 52 and 53 which insertably receive hook 54 and 55 that are attached to opposite ends of a wire or cord 56. The wire or cord may be placed about a suitable hook or nail 57 which is in the wall 51.

Figure 3:
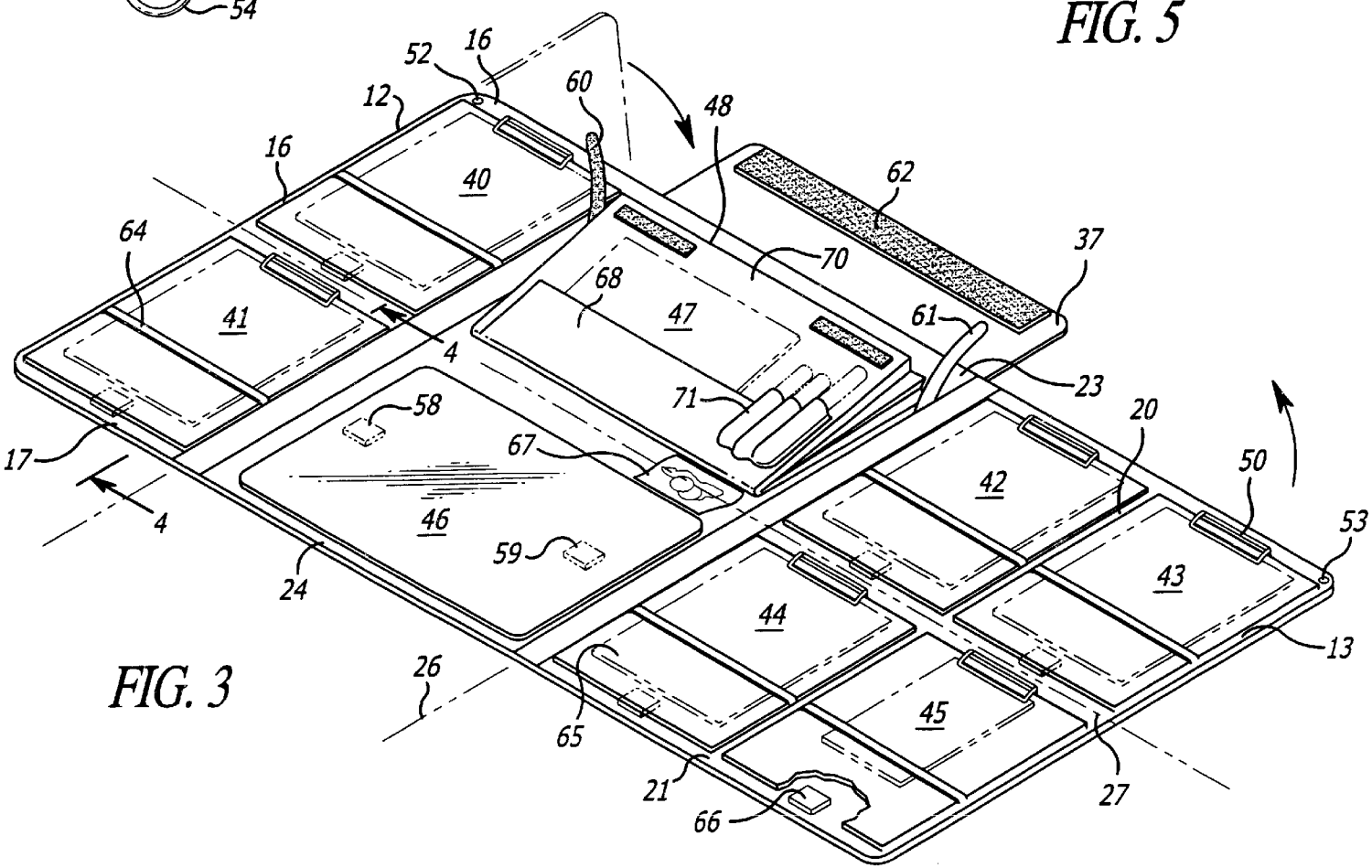
FIG. 3 is a perspective layout view of the folding portfolio organizer and illustrating the organizer in its unfolded position exposing a variety of pads, accordion case, hardboard surface working area, and other features.

Referring now in detail to FIG. 3, a more detailed layout of organizer components is illustrated wherein it can be seen that the central panel having sections 23 and 24 are in the center between lateral or intermediate panels 12 and 13. The lateral or intermediate panels have been opened or deployed outwardly to expose the case 47 and the hard surface board 46. The board 46 may be detachably connected to the section 24 by means of hook and pile fasteners 58 and 59 and it can be seen that the accordion type folder or case 47 has been deployed into its operative position so that an entrance leading through opening 48 is available. Also, it can be seen that the opening can be closed to the case 47 by means of a two-component hook and pile fastener indicated by numeral 60 and numeral 61 taking the form of a strap which folds over and mates with a second component carried on the outside of the case adjacent to the opening 48. Furthermore, when the panels 12 and 13 are folded inwardly, as shown in the direction of the arrows, and the panels are then folded along fold line 27, the panel can be maintained in the storage position by means of folding the flap 37 over the folded panels so that a hook and pile two-component fastener can be indexed and brought together. One component is indicated by numeral 62 while the second component is indicated by numeral 63 in FIG. 1.

FIG. 3 further illustrates that the pads 40–45 inclusive may be retained in position, particularly during the folding and unfolding procedures, by means of straps such as strap 64. Also, pockets may be formed in which to receive the pads, and preferably the pockets are composed of a transparent material, such as indicated by a pocket enclosure 65. In some instances, fasteners may be employed to secure the pocket and/or the pads in position and such a hook and pile component is indicated by numeral 56. A soft, auxiliary pouch 67 may be carried in a marginal region between the board 46 and the bottom of the case 47 and auxiliary buttons, pins, and other small items may be kept in the pouch. In a similar fashion, an elongated pouch 68 is provided on the outside of the case 47 and papers represented by numeral 70 may be tucked into the pouch or pocket as needed. The pocket also includes a plurality of elongated tubular sleeves, such as indicated by numeral 71, into which various writing implements can be releasably held. The various clips, such as clip 50, releasably holds the pads 40–45 inclusive in position on the respective panel sections. The clips are manually operated and can be employed to permit full removal of the pads from their stored position. All of the clips are manually operated.

Referring now in detail to FIG. 4, it can be seen that the construction of the organizer is based on providing stiffening boards such as board 72 with respect to section 17 that is covered by fabric layers 73 and 74 respectively. The layers are joined together by a reinforcement member 75 which is stitched along the edge marginal region of the sheets 73 and 74. On top of the inner sheet 74, a pocket is defined having an interior 75 and a hook and pile closure along the sides thereof represented by numeral 76. To enter the pocket, the hook and pile fastener is released so that entrance is gained to the interior storage cavity 75. The side of the pocket, indicated by numeral 77, may be a sheet of transparent material on which the pad 41 rests and is held in position by the strap 64 as well as the clip 78. In this fashion, the pad may be stored on top of the pocket and entrance to the pocket is through the bottom once the two-component fastener 76 has been released. Construction and arrangement of pockets and pads is the same as carried on sections 16, 20 and 21.

Referring to FIG. 5, it can be seen that the hanger strap 56 is elongated having attachment rings 80 and 81 on its opposite end. The pair of hooks such as indicated by hook 54 is carried on the ring and the hook portion is passed through the grommets 52 and 53 at the corners of the organizer.

Therefore, it can be seen that the folding portfolio organizer of the present invention provides a convenient means for carrying from place to place and when not in use the organizer can be stored in the trunk of a car or other convenient location. Furthermore, when in actual use, the organizer can be carried to an emergency site and deployed into its operative condition by unfolding the panels and the entire organizer can be laid on the hood of a car or other vehicle so that the user has a spread layout of all of the forms and implements needed to collect and note pertinent information pertaining to the emergency situation. A sufficient number of pockets, sleeves, pouches are available to store loose papers and pads of forms or other documents can be easily carried on top of pockets and maintained in position by the variety of manual clips. The hard working surface is available so that good record keeping can be maintained and the accordion style case provides an enlarged area for books, pamphlets or other material. The intended purpose of the present invention is to assist the collection of pertinent information gathered by individuals in emergency situations, such as law enforcement, fire department, military, search and rescue units and the like. The organizer may also be used for commercial purposes, such as for sales people as well as in the construction industry. The organizer can hold many papers so that the papers are not blown away and will provide a working area for the user in the field. The organizer can be readily folded and moved from place to place without disrupting the operation. Likewise, the organizer can also be compactly folded for easy storage and transport. The pad of forms can be specifically inserted into different pockets or maintained on top of the pockets so as to make them available by the user and the forms relate to different and specific occupation or situation requirements ready for insertion or inscribing of pertinent information thereon.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A folding portfolio organizer comprising:

a central panel having opposite sides;

an intermediate panel attached to each of said opposite sides by vertical fold;

said central panel and the intermediate panels each having an upper interior section and a lower interior section joined together by a longitudinal fold;

document forms releasably disposed on each of said upper interior sections and each of said lower interior sections of said intermediate panels;

a foldable case carried on said upper interior section of said central panel; and a hard surface board detachably carried on said lower interior section of said central panel.

2. The organizer defined in claim 1 including:

clip means mounted on the upper interior sections and the lower interior sections of said intermediate panels for releasably retaining said document forms on said upper and said lower interior sections respectively.

3. The organizer defined in claim 2 wherein:

said central panel and said intermediate panels are foldable between a storage position and an operative position along said vertical folds and said longitudinal fold; and said vertical folds being disposed normal with respect to said longitudinal fold.

4. The organizer defined in claim 3 wherein:

each of said upper interior sections and each of said lower interior sections include a strap retainer for releasably holding said document forms on said sections.

5. The organizer defined in claim 4 wherein:

said intermediate panels are laterally disposed with respect to said central panel; and a selected one of said intermediate panels includes two sections and a non-selected intermediate panel includes four sections.

6. The organizer defined in claim 5 wherein:

said intermediate panels fold over said central panel and said lower sections fold over said upper sections so as to define said storage position; and a flap closure carried on said central panel for releasably securing said central panel and said intermediate panels in said storage position.

7. The organizer defined in claim 6 including:

a pair of eyelets provided on said intermediate panels;

an elongated hanger strap having opposite ends detachably connected with said pair of eyelets for hanging said central panel and said intermediate panels in said operative position.

8. A foldable portfolio organizer comprising:

a pair of flexible sheets having edge marginal regions secured together;

multiple stiffeners disposed between said sheets constituting a plurality of sections arranged in horizontal rows and vertical columns;

portions of said sheets constituting flexible plications permitting said sections to be folded over upon themselves to define a storage position and to be unfolded into an operative position;

a selected flexible plication separating said rows of said sections defining a longitudinal folding or pivoting axis with other non-selected flexible plications separating said columns of said sections defining at least a pair of folding or pivoting axis perpendicular to said longitudinal folding or pivoting axis;

a plurality of information recording materials releasably disposed on each of said sections; and selected ones of said sections carrying a detachable hard surface board and an accordion fold case.

9. The organizer defined in claim 8 wherein:

said flexible sheets are folded along said non-selected flexible plications and said selected flexible plication into said storage position.

10. The organizer defined in claim 9 including:

a manually operated clip carried on each of said sections for releasably retaining said information recording material.

11. The organizer defined in claim 10 wherein:

each of said plurality of information recording material is a pad of individual forms carrying indicia relative to gathering of emergency data.

12. The organizer defined in claim 11 including:

a plurality of sleeves secured to said accordion fold case holding a plurality of writing implements.

13. The organizer defined in claim 12 including:

an individual pouch loosely stored adjacent said longitudinal folding or pivoting axis for holding a multiplicity of ancillary items related to use of said information recording material.

14. A foldable portfolio organizer comprising:

a plurality of board stiffeners arranged in parallel rows and parallel columns normal to said parallel rows;

an inner sheet and an outer sheet of flexible fabric material separated by and covering said plurality of board stiffeners;

portions of said inner sheet and said outer sheet joined together between adjacent ones of said board stiffeners to provide a first plication constituting a longitudinal folding axis and at least a pair of parallel plications normal with respect to said first plication whereby said board stiffeners are foldable between an open operative position and a closed storage and carrying position;

a pad of information recording sheets releasably disposed on said inner sheet backed by said board stiffener;

a hard surface board detachably carried on said inner sheet adjacent a selected one of said board stiffeners; and a foldable accordion type brief case secured to said inner sheet adjacent another selected one of said board of stiffeners.

15. The organizer defined in claim 14 including:

a closure flap secured to said outer sheet;

a hook and pile releasable fastener cooperatively disposed on said flap and said outer sheet to retain said board stiffeners in said closed storage and carrying position.

16. The organizer defined in claim 15 including:

a hanger strap detachably coupled with said outer sheet for hangably supporting said board stiffeners.

17. The organizer defined in claim 16 including:

a carrier strap means secured to said outer sheet for carrying said board stiffeners in said closed storage and carrying position.

18. The organizer defined in claim 8 including:

said pair of sheets providing an inner sheet on which said information recording material is carried and an outer sheet serving as an exterior surface; and a hook and pile closure fastener carried on said outer sheet for releasably retaining said sections in said storage position.

19. The organizer defined in claim 9 including:

handle means secured to said outer sheet exterior surface having a pair of handle straps cooperating to provide a carrying means for transporting organizer.

* * * * *